US011937686B2

(12) United States Patent
Bevis

(10) Patent No.: US 11,937,686 B2
(45) Date of Patent: Mar. 26, 2024

(54) CARRYING CASE WITH PIVOTING HOUSING

(71) Applicant: BEVIS GEAR INC., Vancouver (CA)

(72) Inventor: Matthew Bevis, Vancouver (CA)

(73) Assignee: BEVIS GEAR INC.

( * ) Notice: Subject to any disclaimer, the term of this patent is extended or adjusted under 35 U.S.C. 154(b) by 0 days.

(21) Appl. No.: 17/309,147

(22) PCT Filed: Nov. 5, 2019

(86) PCT No.: PCT/CA2019/051575

§ 371 (c)(1),
(2) Date: Apr. 29, 2021

(87) PCT Pub. No.: WO2020/093154

PCT Pub. Date: May 14, 2020

(65) Prior Publication Data

US 2021/0378390 A1 Dec. 9, 2021
US 2022/0160114 A2 May 26, 2022

Related U.S. Application Data

(60) Provisional application No. 62/756,069, filed on Nov. 5, 2018.

(51) Int. Cl.
*A45F 3/02* (2006.01)
*A45F 3/04* (2006.01)

(52) U.S. Cl.
CPC ..... *A45F 3/047* (2013.01); *A45F 3/02* (2013.01)

(58) Field of Classification Search
CPC .... A45F 3/047; A45F 3/02; A45F 3/12; A45F 3/04; A45F 3/00; A45F 3/08; A45C 13/30; A45C 11/38; A45C 3/06; A47B 23/002

(Continued)

(56) References Cited

U.S. PATENT DOCUMENTS 4,323,180 A * 4/1982 Sloop ..... A45F 3/02 224/601
5,636,778 A 6/1997 Jones et al.

(Continued)

FOREIGN PATENT DOCUMENTS

DE 20 2015 106 528 U1 1/2016
DE 202017006882 U1 9/2018

(Continued)

OTHER PUBLICATIONS

WO-2004099797-A1 machine translation (Year: 2004).*

(Continued)

*Primary Examiner* — Nathan J Newhouse
*Assistant Examiner* — Matthew T Theis
(74) *Attorney, Agent, or Firm* — Lewis Roca Rothgerber Christie LLP

(57) ABSTRACT

A carrying case comprises a housing having a top, a bottom, a front, and a rear. There are sides extending between the front and the rear of the housing. There is a guide member extending along the bottom of the housing. The carrying case further comprises a carrying strap having a first end and a second end. The first end of the carrying strap is connected near the top of the housing and the second end of the carrying strap is coupled to the guide member. The second end of the carrying strap is movable along the guide member to allow the carrying case to be moved between different configurations.

19 Claims, 11 Drawing Sheets

(58) Field of Classification Search
USPC ..... 224/627
See application file for complete search history.

(56) References Cited

U.S. PATENT DOCUMENTS

| | | | | |
|---|---|---|---|---|
| 5,762,250 | A * | 6/1998 | Carlton | A47B 23/002 206/320 |
| 5,908,147 | A * | 6/1999 | Chuang | A45C 13/02 224/655 |
| 6,793,112 | B2 * | 9/2004 | Ammerman | A45F 3/02 224/264 |
| 8,302,642 | B1 | 11/2012 | Lindholm | |
| 2004/0089687 | A1 | 5/2004 | Ammerman | |
| 2007/0151487 | A1 * | 7/2007 | Villapanda | A47B 23/043 108/43 |
| 2012/0152417 | A1 | 6/2012 | Thomas et al. | |
| 2018/0110310 | A1 | 4/2018 | Chang | |

FOREIGN PATENT DOCUMENTS

| | | | | |
|---|---|---|---|---|
| JP | 10-262721 | A | 10/1998 | |
| WO | WO-2004099797 | A1 * | 11/2004 | G01D 11/24 |

OTHER PUBLICATIONS

International Search Report issued in PCT/CA2019/051575, dated Jan. 28, 2020, 3 pages.
Written Opinion of the International Searching Authority issued in PCT/CA2019/051575, dated Jan. 28, 2020, 5 pages.
Extended European Search Report dated Nov. 2, 2021, for corresponding European Patent Application No. 19882189.4 (7 pages).

* cited by examiner

CARRYING CASE WITH PIVOTING HOUSING

CROSS-REFERENCE TO RELATED APPLICATION(S)

This application is a National Phase entry of PCT/CA2019/051575 filed Nov. 5, 2019, which claims priority to and the benefit of U.S. Provisional Patent Application No. 62/756,069 filed Nov. 5, 2018, the entire contents of both of which are incorporated herein by reference.

TECHNICAL FIELD

The present disclosure relates to a carrying case and, in particular, to a carrying case which is accessible from the front while being worn by a user.

BACKGROUND

U.S. Pat. No. 7,316,340, which issued on Jan. 8, 2008 in the name of Marik, discloses an altered backpack which allows the wearer to reconfigure the shoulder straps while wearing the backback. The wearer can also swing the backpack around to the wearer's front, and access the contents of the backpack while still wearing the backpack. The backpack comprises a first primary shoulder strap and a second primary shoulder strap. The first primary shoulder strap comprises two segments. The upper segment has one end connected near the top of the backpack and the lower segment has one end connected near the bottom of the backpack. The second ends of the first primary shoulder strap are separably connected together by a buckle.

SUMMARY OF THE DISCLOSURE

It is an object of the present invention to provide a carrying case which can be easily accessed from the front while being worn by a user.

There is accordingly provided a carrying case comprising a housing having a top, a bottom, a front, and a rear. There are sides extending between the front and the rear of the housing. There is a guide member extending along the bottom of the housing. The carrying case further comprises a carrying strap having a first end and a second end. The first end of the carrying strap is connected near the top of the housing and the second end of the carrying strap is coupled to the guide member. The second end of the carrying strap is movable along the guide member to allow the carrying case to be moved between different configurations. The guide member may be a loop. The second end of the carrying strap may be a loop which engages with the loop of the guide member.

The carrying case may include an adjustable stop cord which restricts movement of the second end of the carrying strap along the guide member. The carrying case may also include an additional carrying strap. The additional carrying strap may have a first end and a second end. The first end of the additional carrying strap may be connected near the top of the housing and the second end of the additional carrying strap may be connected near the bottom of the housing.

The carrying case may include one or more reinforcement frames which extend around a perimeter of the housing. The carrying case may include a lid which provides access to an interior of the housing.

DESCRIPTION OF SPECIFIC EMBODIMENTS

Figure 1:
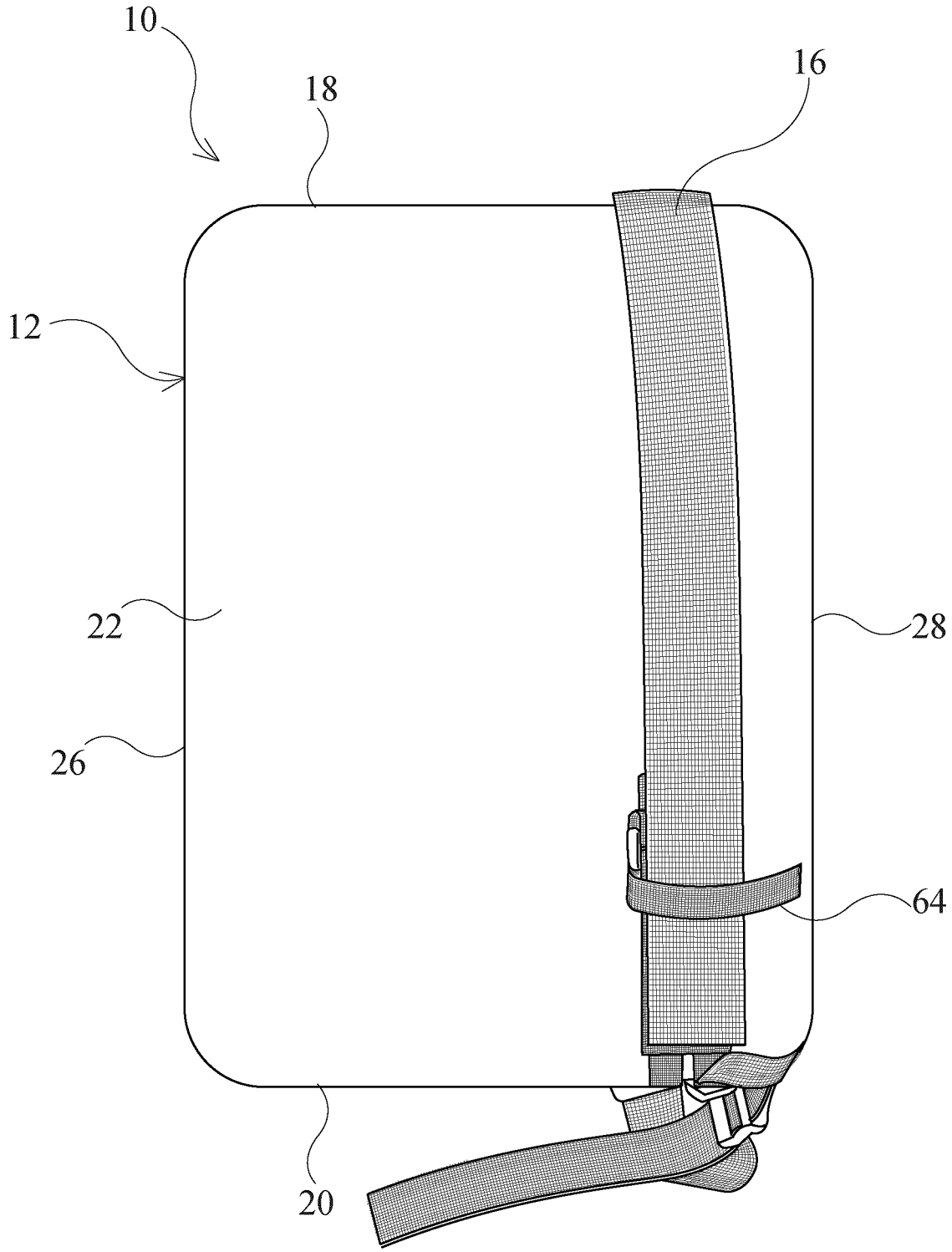
FIG. 1 is a front view of a carrying case.
Figure 2:
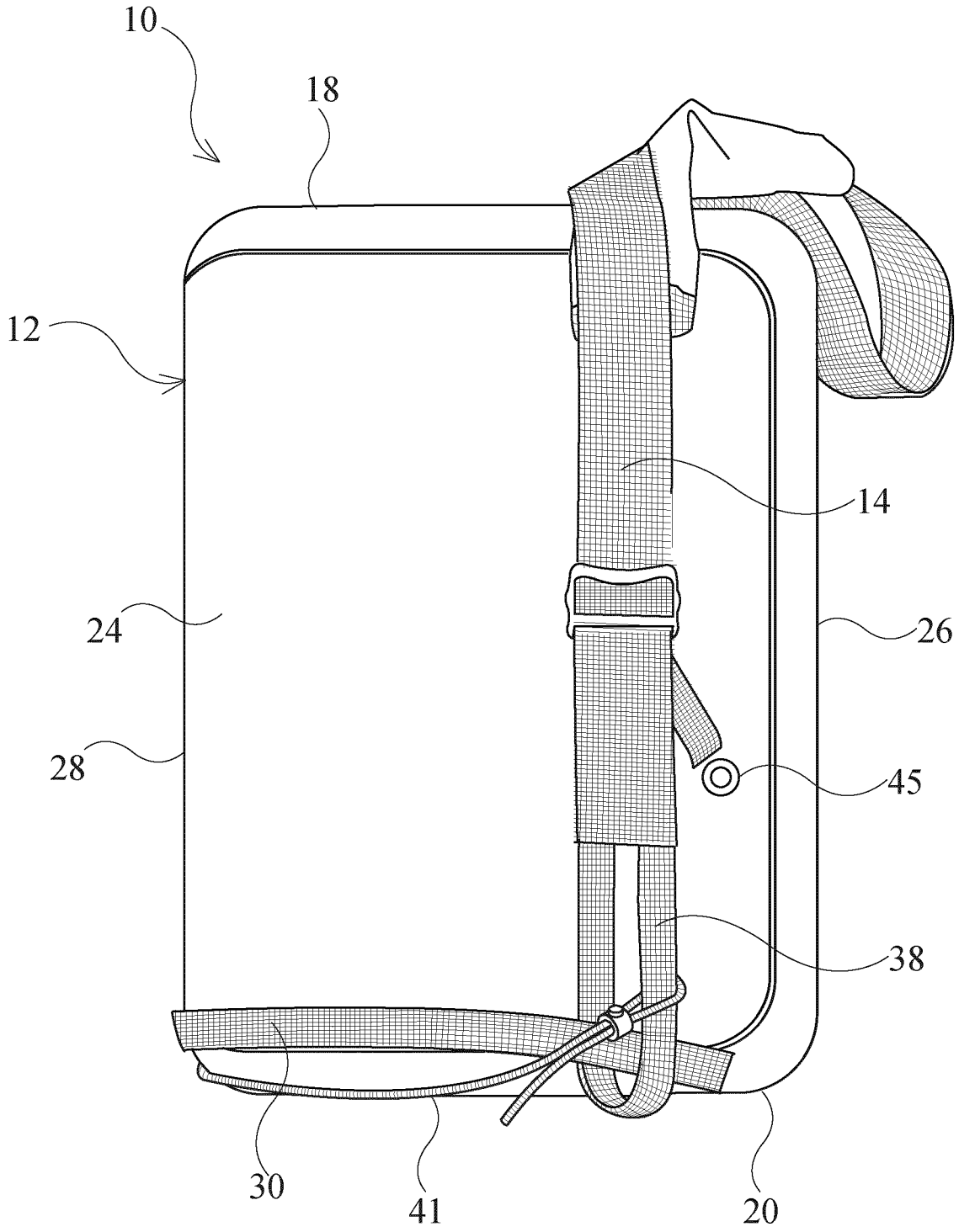
FIG. 2 is a rear view of the carrying case of FIG. 1.
Figure 8:
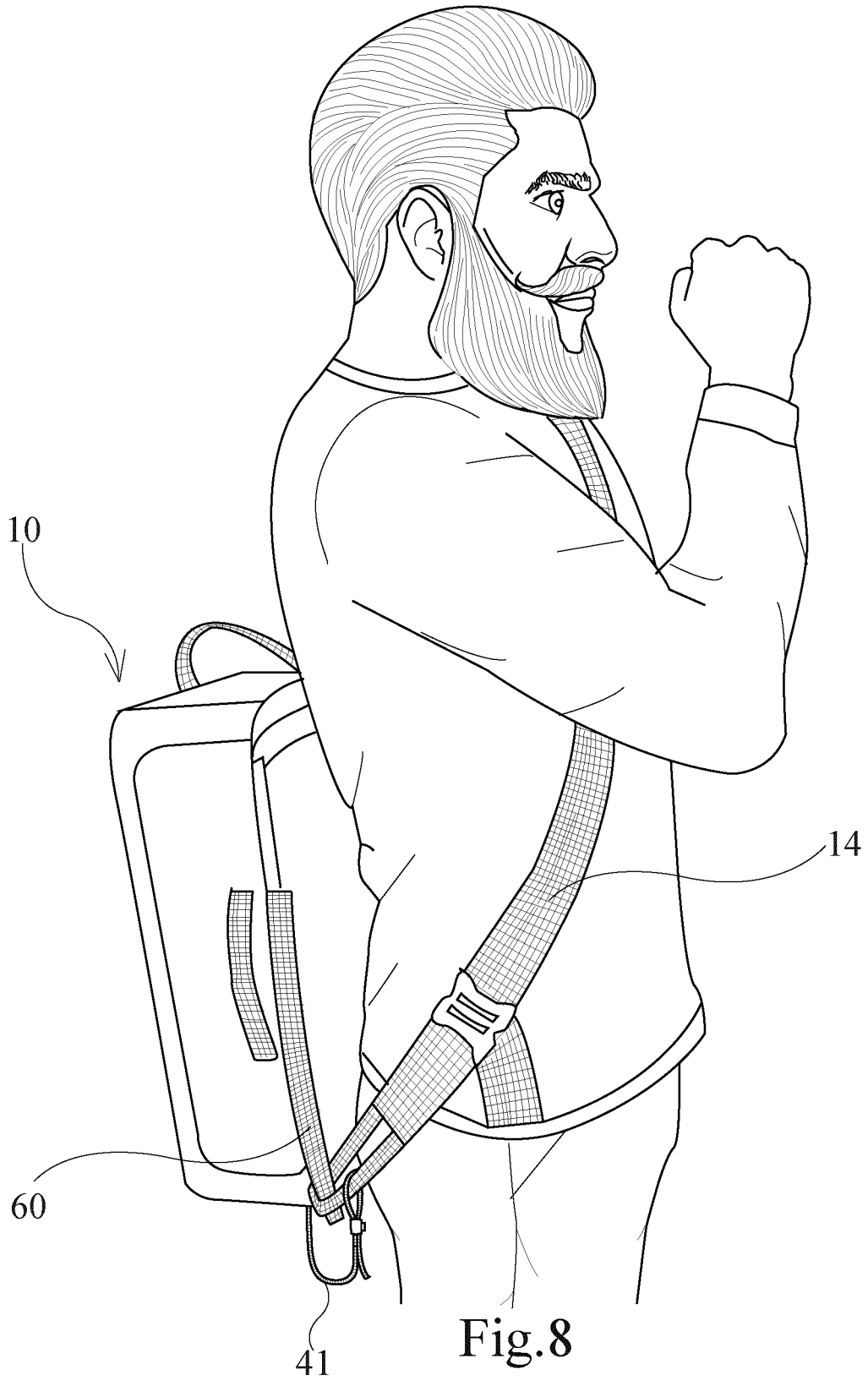
FIG. 8 is a perspective view of the carrying case of FIG. 1 being worn on a user's back.

Referring to the drawings and first to FIGS. 1 and 2, there is shown a carrying case 10. The carrying case 10 includes a housing 12, a primary carrying strap 14 (shown in FIG. 2), and a secondary carrying strap 16 (shown in FIG. 1). The housing 12 may be made of fabric or a rigid material such as hard plastic or rigid foam. The housing 12 is generally rectangular in this example and includes a top 18, a bottom 20, a front 22, and a rear 24. The terms "top", "bottom", "front" and "rear" of the housing 12 as used herein refer to the position of the carrying case 10 when worn on a user's back as shown in FIG. 8. Referring back to FIG. 1, there are opposed sides 26 and 28 extending between the front 22 and the rear 24. There is a guide member 30 extending along the bottom 20 of the housing 12. The guide member 30 is generally strap-like in this example and forms a loop with the housing 12, but may be a different shape in other examples.

Figure 3:
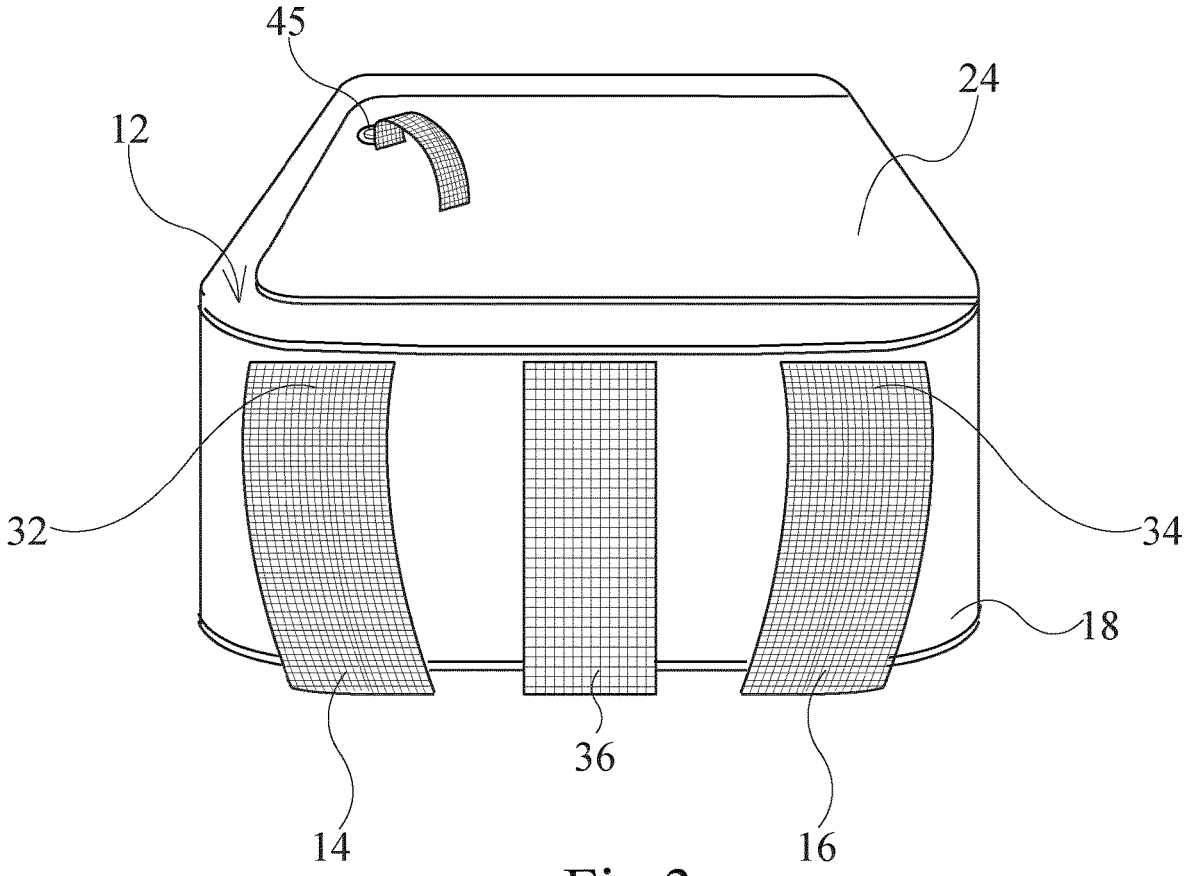
FIG. 3 is a top view of the carrying case of FIG. 1.
Figure 4:
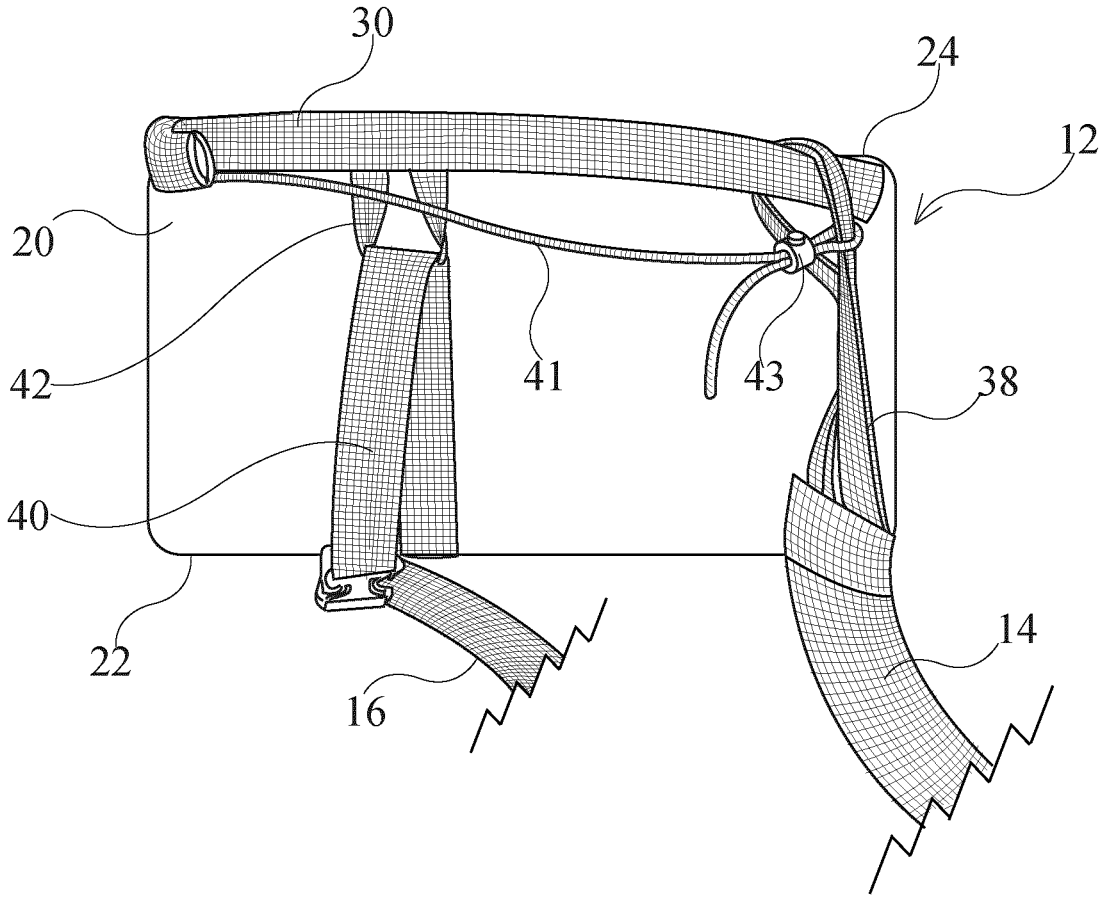
FIG. 4 is a bottom view of the carrying case of FIG. 1.

As best shown in FIG. 3, the primary carrying strap 14 has a first end 32 which is connected near the top 18 of the housing 12. The secondary carrying strap 16 also has a first end 34 which is connected near the top 18 of the housing 12. There may be a handle 36 extending from the top 18 of the housing 12. Referring now to FIG. 4, the primary carrying strap 14 has a second end 38 which is connected near the bottom 20 of the housing 12 via the guide member 30. The secondary carrying strap 16 also has a second end 40 which is connected near the bottom 20 of the housing 12. In this example, the second end 40 of the secondary carrying strap 16 is a loop which engages with a loop element 42 extending from the bottom 20 of the housing 12 to couple the secondary carrying strap 16 to the housing 12. The second end 38 of the primary carrying strap 14 is a loop in this example and engages with the guide member 30. The second end 38 of the primary carrying strap 14 can travel along a length of the guide member 30, thereby allowing the second end 38 of the primary carrying strap 14 to move along a length of the bottom 20 of the housing 12.

There may be an adjustable stop cord 41 connected at one end to the housing 12 and at the other end to the primary carrying strap 14. In this example, the cord 41 is fed through a cord lock 43 and looped around the second end 38 of the primary carrying strap 14. The length of the cord 41 can be adjusted by toggling the cord lock 43. This in turn limits the distance that the second end 38 of the primary carrying strap 14 can travel along the length of the guide member 30.

In the example shown in FIG. 4, the guide member 30 is connected to the bottom 20 of the housing 12 near the rear 24 of the housing 12. However, the guide member 30 may be connected to the bottom 20 of the housing 12 at different locations between the front 22 and the rear 24 of the housing 12 in other examples. In further examples, the second end 38 of the primary carrying strap 14 may be connected to the front 22 of the housing 12 and guided along the length of the bottom 20 of the housing 12 by the guide member 30 as the primary carrying strap 14 is pivoted about its connection point to the housing 12.

Figure 5:
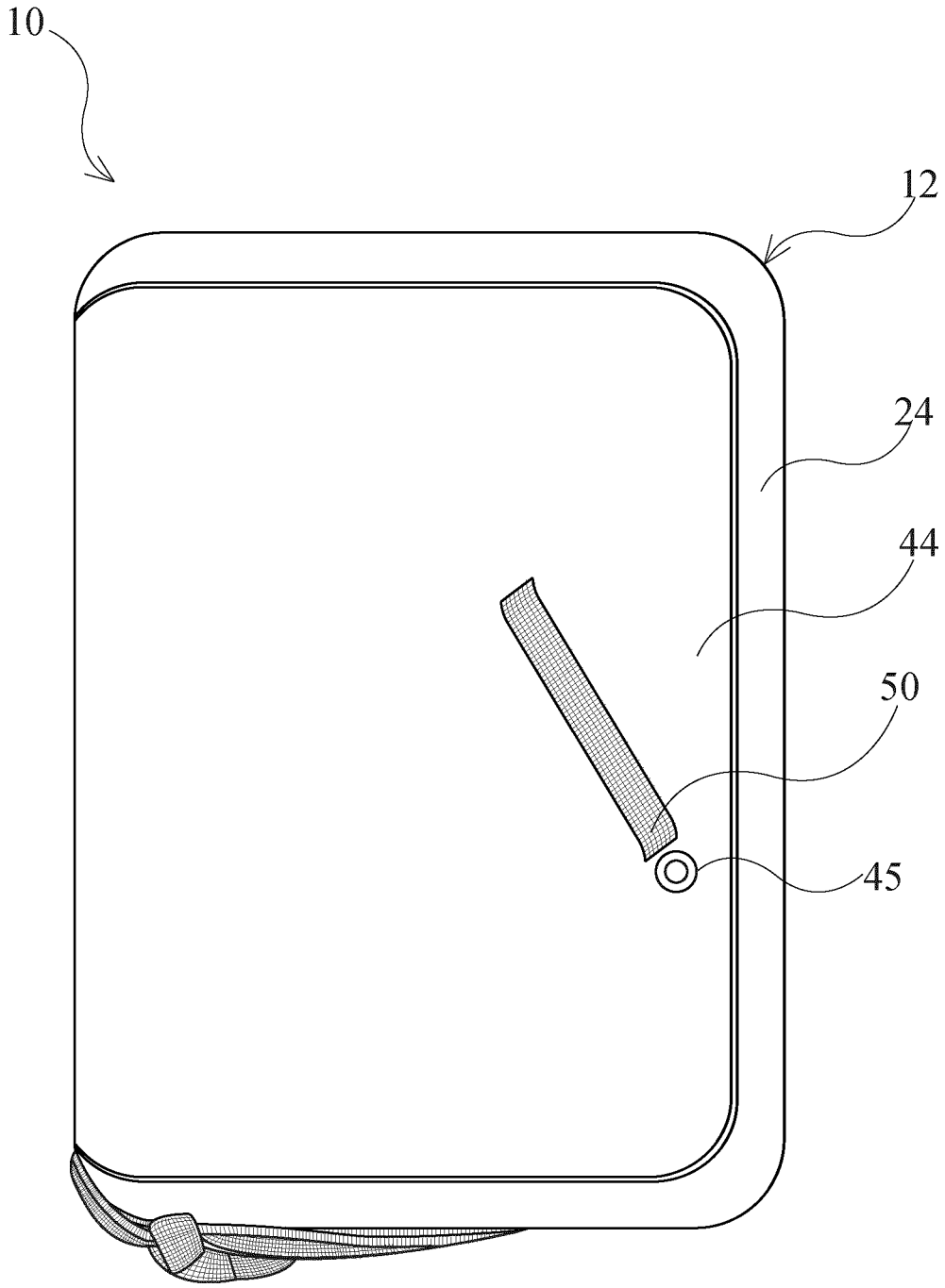
FIG. 5 is another rear view of the carrying case of FIG. 1 showing a lid for accessing an interior of the carrying case.
Figure 6:
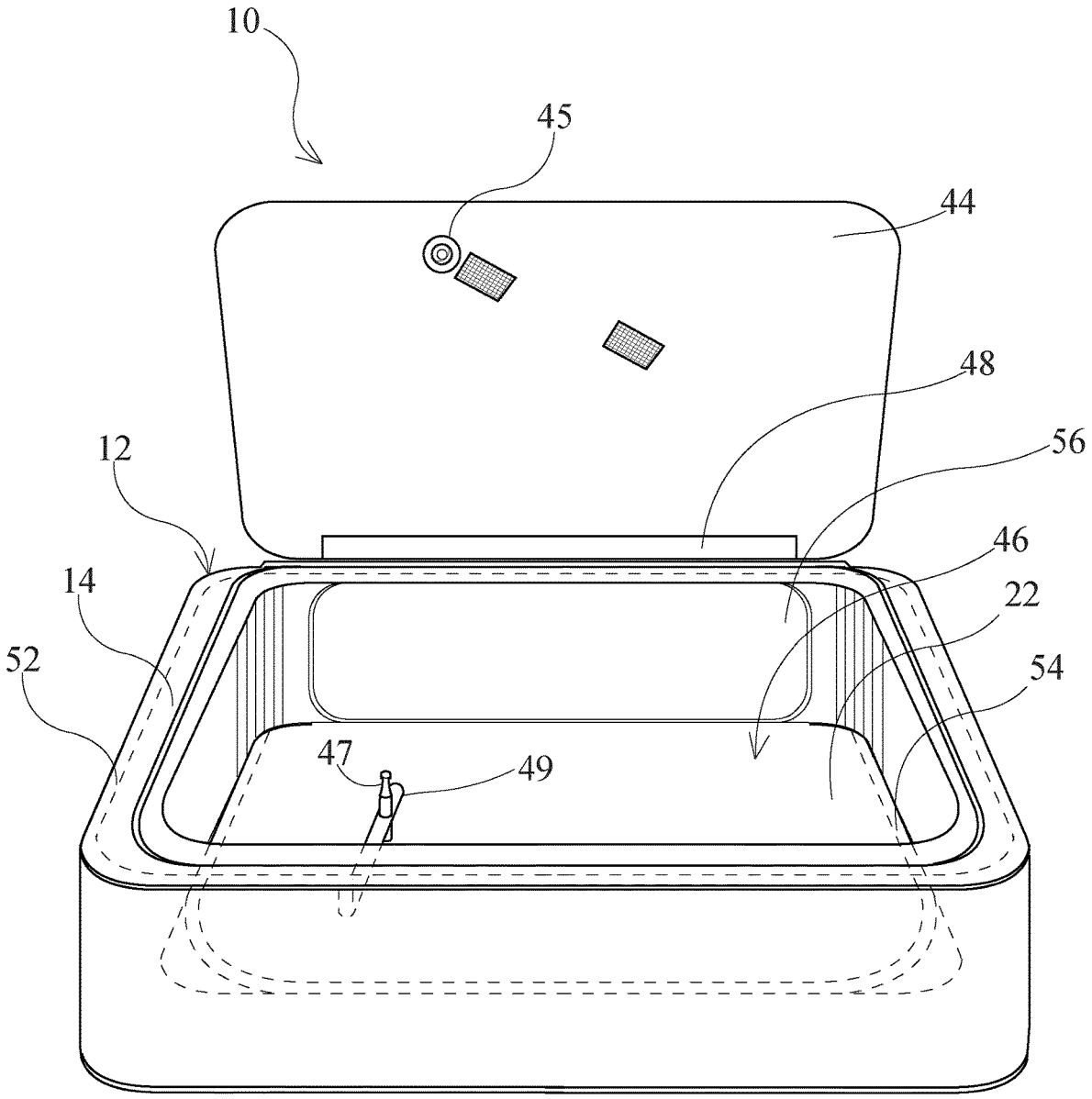
FIG. 6 is a perspective view of the carrying case of FIG. 1 showing the interior of the carrying case.
Figure 7:
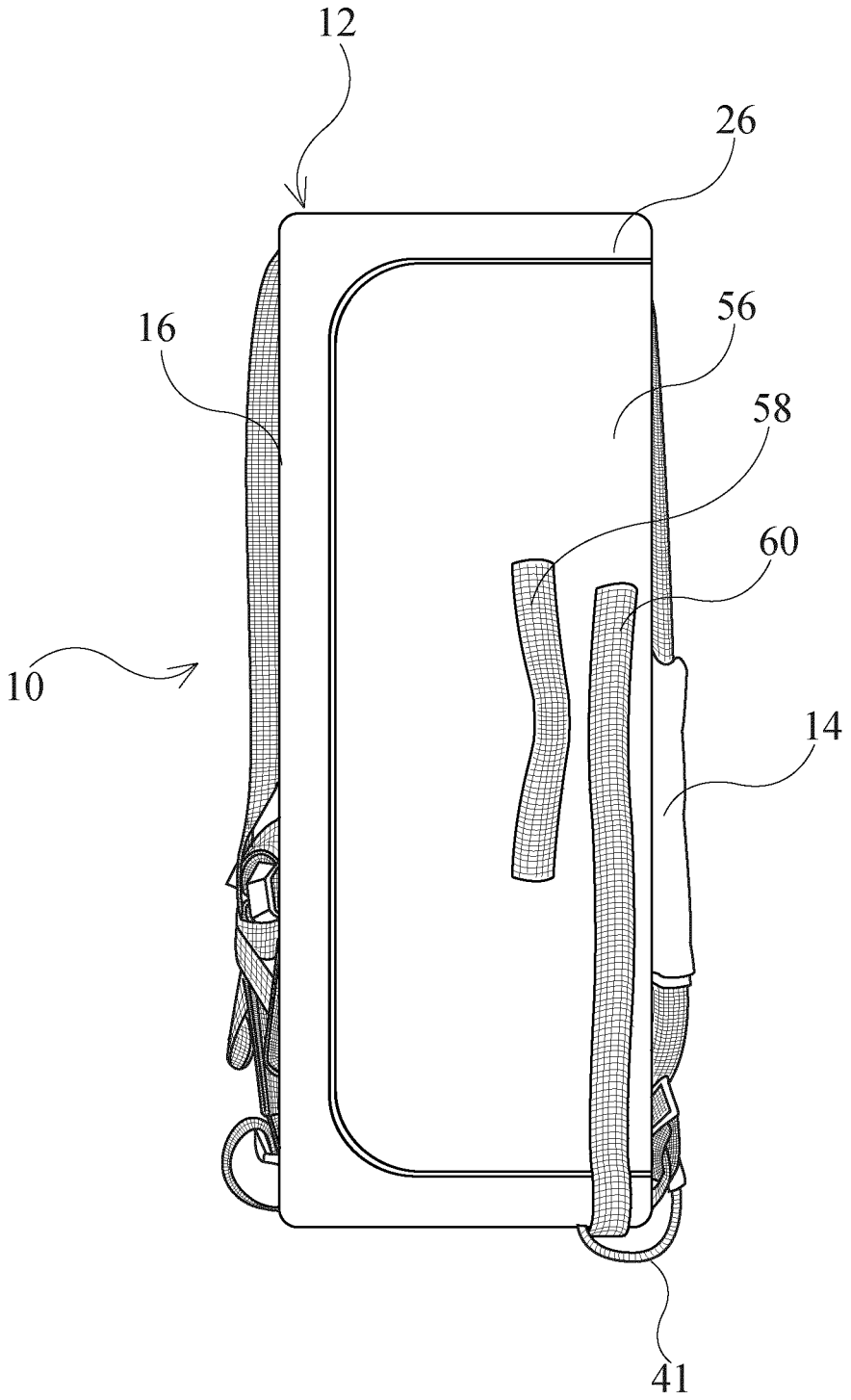
FIG. 7 is a side view of the carrying case of FIG. 1.

Referring now to FIGS. 5 and 6, the rear 24 of the housing 12 includes a lid 44 which provides access to an interior 46 of the housing 12. This allows a user to store items in and retrieve items from the carrying case 10. The lid 44 may be hingedly connected to the housing 12 by a hinge 48. The lid 44 may be provided with a handle 50 to facilitate opening and closing of the lid 44. In this example, there is a reinforcement frame 52 extending around a perimeter of the rear 24 of the housing 12 and a reinforcement frame 54 extending around a perimeter of the front 22 of the housing 12. The reinforcement frames may be made of metal, plastic or other suitably stiff materials. The reinforcement frame 54 is generally U-shaped in this example to avoid obstructing side access to the interior 46 of the housing 12 via a lid 56. If the housing 12 is made of a fabric material, the reinforcement frames 52 and 54 may be under tension to provide structure to the carrying case 10. As shown in FIG. 7, the lid 56 may be provided with a handle 58 to facilitate opening and closing of the lid 56. There may also be another handle 60 extending from the side 26 of the housing 12.

The lid 44 may be provided with a quick release mechanism to allow for ease of access to the interior 46 of the housing 12. In this example, the quick release mechanism is a push button latch which includes a push button 45 and a pin 47. The push button 45 is disposed on the lid 44 and engages with the pin 47 to secure the lid 44 to the housing 12. The lid 44 can be opened by actuating the push button 45 to release the push button 45 from the pin 47. In this example, the pin 47 is connected to the reinforcement frame 52 by a rod member 49. The rod member 49 may be welded to the reinforcement frame 52. The lid 44 may further include a magnetic closure. The lid 44 may have a zipper to releasably close the interior 46 of the housing 12.

Figure 9:
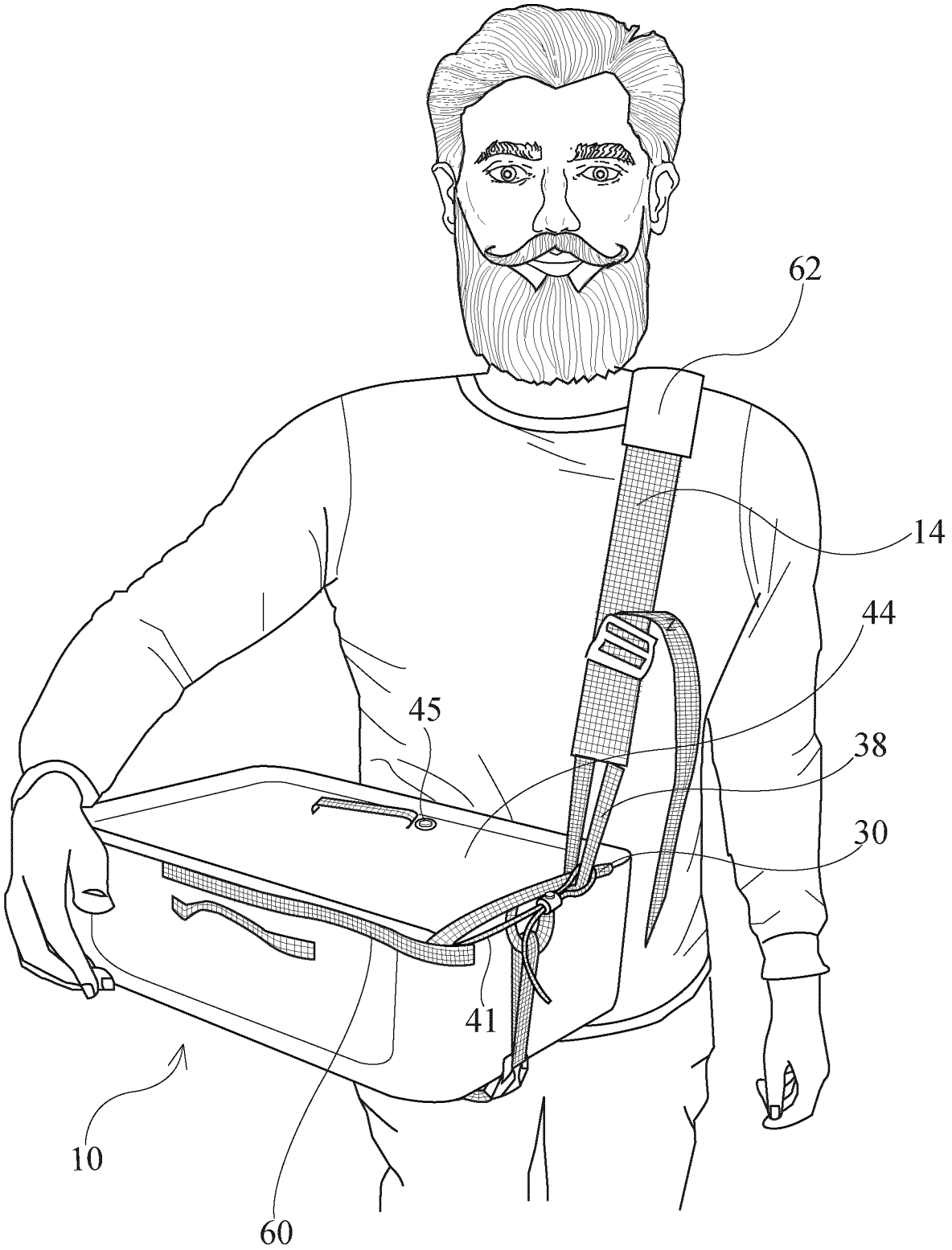
FIG. 9 is a perspective view of the carrying case of FIG. 1 being accessed from the user's front while being worn by the user.

FIG. 8 shows the carrying case 10 worn by a user. In this position, the carrying case 10 is positioned against the user's back. The carrying case 10 is supported on the user's shoulder by the primary carrying strap 14 which extends across the user's torso. To access the contents of the carrying case 10, the user can swing the carrying case 10 around to the user's front as shown in FIG. 9. This swinging motion is enabled by the second end 38 of the primary carrying strap 14 travelling along the guide member 30 as the carrying case 10 is swung around to the user's front. The user can use the handle 60 to facilitate swinging the carrying case 10 forward and backward.

The platform position shown in FIG. 9 allows the user to quickly and easily access the contents of the carrying case 10 via the lid 44. Furthermore, since the contents of the carrying case 10 can be accessed in a horizontal configuration, items can be stored side by side instead of stacked on top of each other for easier access. The reinforcement frames 52 and 54, shown in FIG. 6, provide structure to the carrying case 10 and keep the guide member 30 under tension so that the second end 38 of the primary carrying strap 14 can travel along the guide member 30. However, the reinforcements frames 52 and 54 may not be required if the housing 12 is constructed of a rigid material such as hard plastic, or rigid or thick foam. The carrying case 10 is supported by the primary carrying strap 14 against the user's body so the user can have both hands free. This allows the user to store and retrieve items which may require use of both hands, such as camera gear. The stop cord 41 restricts rearward movement of the second end 38 of the primary carrying strap 14 along the guide member 30. By having the primary carrying strap 14 stop further forward, it can make the carrying case more stable in the platform position.

Figure 10:
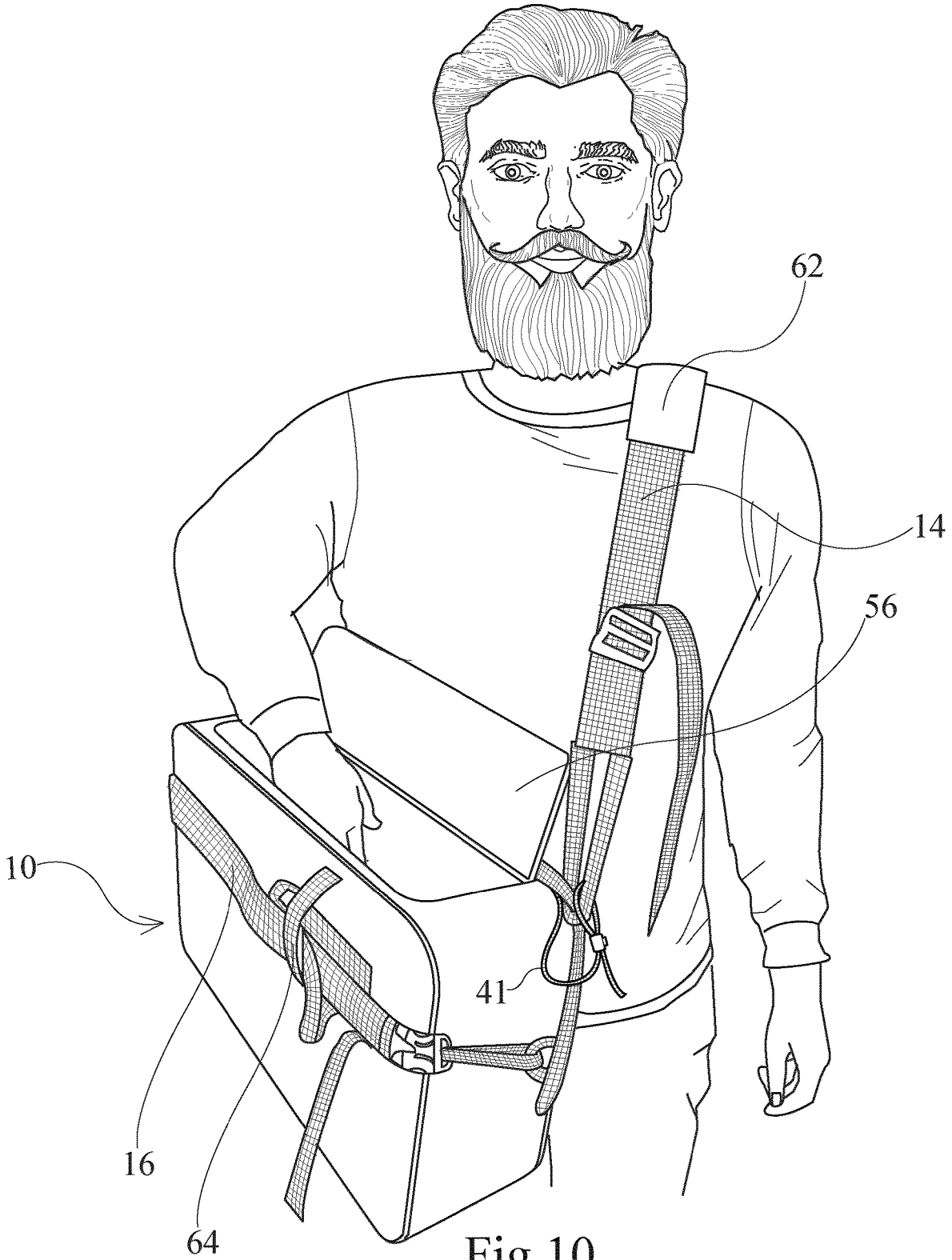
FIG. 10 is a perspective view of the carrying case of FIG. 1 showing the carrying case rotated ninety degrees from the position shown in FIG. 9.

The carrying case 10 can also be rotated ninety degrees from the position shown in FIG. 9 to the position shown in FIG. 10 to allow side access to the contents of the housing 12 via the lid 56. Again, the second end 38 of the primary carrying strap 14 travels along the guide member 30 to permit rotation of the carrying case 10. The primary carrying strap 14 may also be provided with a padded portion 62 for added comfort.

Figure 11:
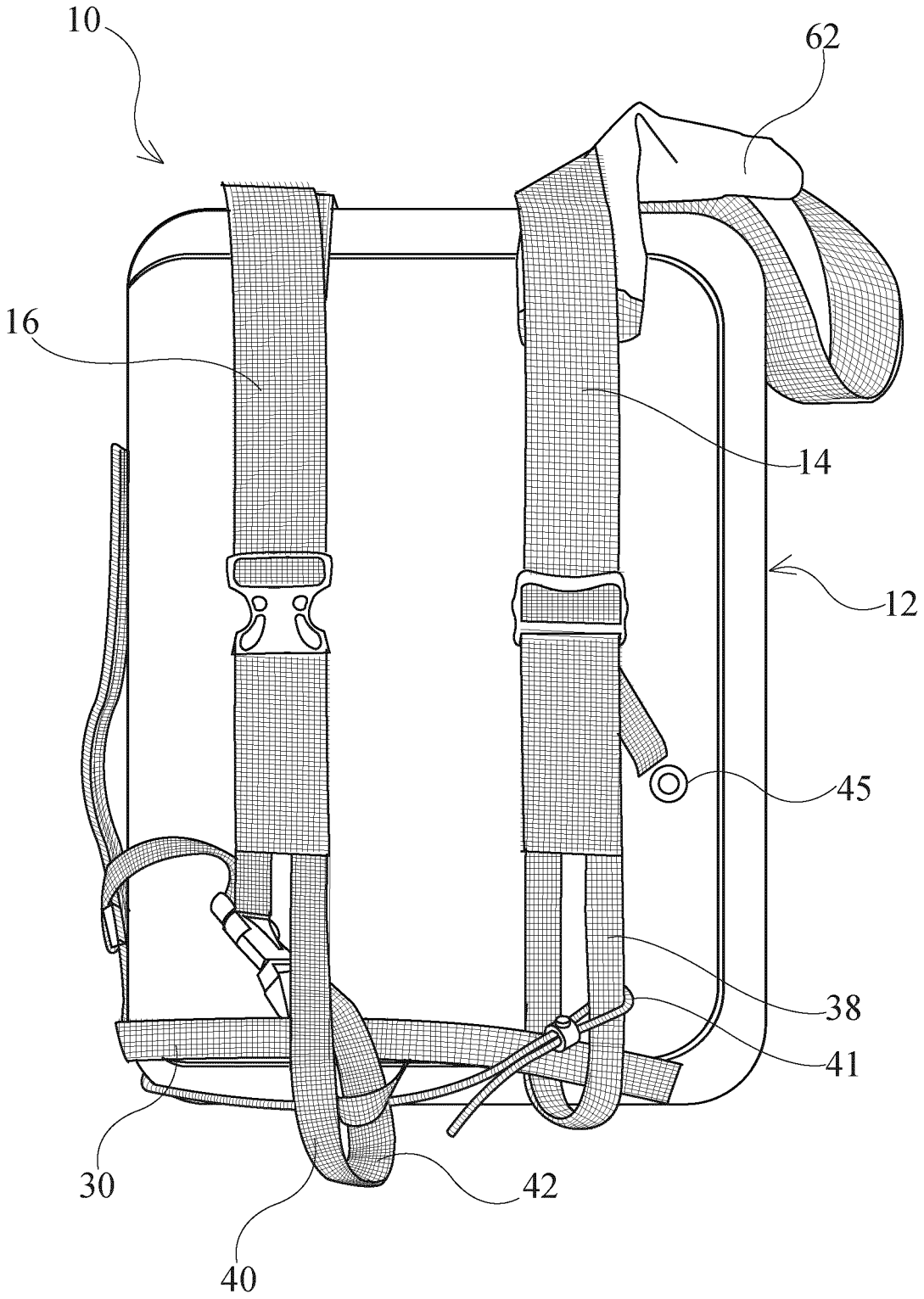
FIG. 11 is another rear view of the carrying case of FIG. 1 showing both carrying straps.

FIGS. 8 to 10 show the carrying case 10 used only with the primary carrying strap 14, where the secondary carrying strap 16 is stowed away and secured to the carrying case 10 by a securing strap 64. However, the secondary carrying strap 16 may be released from the securing strap 64, shown in FIG. 10, to allow the secondary carrying strap 16 to be used in conjunction with the primary carrying strap 14 as shown in FIG. 11. The carrying case 10 can accordingly be worn with two carrying straps to distribute the weight on both of the user's shoulders. In other examples, the secondary carrying strap 16 may be stowed away and secured to the carrying case 10 by a fastener, for example, a button.

It will be understood by a person skilled in the art that many of the details provided above are by way of example only, and are not intended to limit the scope of the invention which is to be determined with reference to the following claims.

What is claimed is:

1. A carrying case comprising:

a housing having a top, a bottom, a front, a rear, and sides extending between the front and the rear;

a guide member extending along at least 50 percent of an entire width of the bottom of the housing at an edge between the bottom of the housing and the rear of the housing; and a carrying strap having a first end and a second end, the first end being connected at the top of the housing and the second end being coupled to the guide member for movement with respect to the guide member, wherein the second end of the carrying strap is configured to be movable along the guide member in response to a user moving the carrying case between different configurations adjacent the user, movement of the second end of the carrying strap with respect to the guide member limiting movement of the housing between the different configurations comprising:

a stored position on a back of the user, wherein the housing is oriented such that the rear of the housing is against the back of the user and the top and the bottom of the housing define parallel planes generally perpendicular to a vertical axis defined by the user, a first accessible position in front of the user wherein the housing is oriented such that the front and the rear define parallel planes generally perpendicular to the vertical axis, and a second accessible position in front of the user wherein the housing is oriented such that the front and rear define parallel planes generally parallel to the vertical axis.

2. The carrying case as claimed in claim 1, wherein the guide member is a loop.

3. The carrying case as claimed in claim 2, wherein the second end of the carrying strap is a loop which engages with the loop of the guide member.

4. The carrying case as claimed in claim 1, further including an additional carrying strap, the additional carrying strap having a first end and a second end, the first end of the additional carrying strap being connected at the top of the housing and the second end of the additional carrying strap being connected at the bottom of the housing.

5. The carrying case as claimed in claim 4, wherein the additional carrying strap is releasably secured against the housing of the carrying case when the additional carrying strap is not in use.

6. The carrying case as claimed in claim 1, further including an adjustable stop cord which restricts movement of the second end of the carrying strap along the guide member.

7. The carrying case as claimed in claim 1, further including one or more reinforcement frames extending around a perimeter of the housing.

8. The carrying case as claimed in claim 7, wherein the one or more reinforcement frames comprises a first reinforcement frame extending along a perimeter of the housing at the rear of the housing and a second reinforcement frame extending along the perimeter at the front of the housing.

9. The carrying case as claimed in claim 8, further comprising at least one lid configured to provide access to an interior of the housing.

10. The carrying case as claimed in claim 9, wherein the at least one lid is formed in one of the sides of the housing and is configured to provide access to the interior of the housing and the housing is in the second accessible position.

11. The carrying case as claimed in claim 9, wherein the at least one lid is formed in the rear of the housing and is configured to provide access to the interior of the housing and the housing is in the first accessible position.

12. The carrying case as claimed in claim 11, further comprising a quick release mechanism configured to lock the at least one lid in place.

13. The carrying case as claimed in claim 12, wherein the quick release mechanism comprises a push button latch comprising a push button on the at least one lid and a pin extending from the one of the first and second reinforcement frames, the push button engaging with the pin to releasably secure the at least one lid to the housing in a closed position whereby pressing the push button releases the push button from the pin to permit movement of the at least one lid to an open position.

14. The carrying case as claimed in claim 12, wherein the quick release mechanism comprises a magnetic closure.

15. The carrying case as claimed in claim 1, further including at least one lid which provides access to an interior of the housing.

16. The carrying case as claimed in claim 15, further comprising a zipper fastening about a portion of a perimeter of the at least one lid to releasably close the at least one lid.

17. The carrying case as claimed in claim 1, wherein in the stored position, the second end of the carrying strap rests at a first end of the guide member at the edge between the bottom of the housing and the rear of the housing.

18. The carrying case as claimed in claim 17, wherein movement from the stored position to the first accessible position is controlled by the second end of the carrying strap moving from the first end of the guide member toward a second end of the guide member along the edge between the bottom on the housing and the rear of the housing.

19. The carrying case as claimed in claim 17, wherein movement from the first accessible position to the second accessible position is controlled by the second end of the carrying strap moving toward the first end of the guide member as the front and the rear of the housing are rotated from being generally perpendicular to the vertical axis to being generally parallel.

* * * * *